US005551669A

United States Patent [19]

Reinklou

[11] Patent Number: 5,551,669

[45] Date of Patent: Sep. 3, 1996

[54] GUARD RAIL FITTINGS

[75] Inventor: Lars A. Reinklou, Ostersund, Sweden

[73] Assignee: Reinklou Innovation AB, Follinge, Sweden

[21] Appl. No.: 199,154

[22] PCT Filed: Aug. 26, 1992

[86] PCT No.: PCT/SE92/00588

§ 371 Date: Apr. 28, 1994

§ 102(e) Date: Apr. 28, 1994

[87] PCT Pub. No.: WO93/04249

PCT Pub. Date: Mar. 4, 1993

[30] Foreign Application Priority Data

Aug. 27, 1991 [SE] Sweden ..... 9102452

[51] Int. Cl.[6] ..... E04H 17/00

[52] U.S. Cl. ..... 256/65; 256/67; 256/DIG. 6; 182/113; 403/79

[58] Field of Search ..... 256/DIG. 6, 67, 256/65; 182/113; 403/79, 157

[56] References Cited

U.S. PATENT DOCUMENTS

| | | | |
|---|---|---|---|
| 3,923,349 | 12/1975 | Herbst | 403/79 X |
| 4,078,772 | 3/1978 | Carbone | 256/65 X |
| 4,114,861 | 9/1978 | Long | 256/67 |
| 4,181,293 | 1/1980 | Laribee | 256/67 |
| 4,208,038 | 6/1980 | Reid | 256/65 |
| 4,286,772 | 1/1981 | Parisien | 256/65 |
| 4,338,040 | 7/1982 | Hawkins | 182/113 X |
| 4,702,447 | 10/1987 | Westwood, III | 403/157 X |
| 5,026,028 | 6/1991 | Ooi et al. | 256/67 |
| 5,286,130 | 2/1994 | Mueller | 403/79 |
| 5,362,030 | 11/1994 | Iler, Jr. et al. | 256/65 |

FOREIGN PATENT DOCUMENTS

| | | | |
|---|---|---|---|
| 0463159 | 3/1974 | Australia | 403/157 |
| 2503774 | 10/1982 | France | 182/113 |
| 3823358 | 1/1990 | Germany . | |
| 0085679 | 6/1955 | Sweden . | |

*Primary Examiner*—Wynn E. Wood
*Attorney, Agent, or Firm*—Young & Thompson

[57] ABSTRACT

Fitting (1) for forming guard rails of posts or for anchoring guard elements with elongated guard elements, removably mounted in the fittings, such as boards, pipes, aluminum profiles or the like, or guard elements made as protective nets. The fitting (1) comprises an upper (2) and a lower (6) separate main component supporting individual guard elements. The ends (12, 34) of the components (2, 6) facing each other are each provided with a laterally extending lug (14, 36). The lugs are pivotably joined to each other and a clevis is pivotably mounted about the lugs (14, 36) and is provided with an anchoring pin (26) disposed essentially perpendicular to the pivot axis of the lugs.

11 Claims, 3 Drawing Sheets

Figure 1:
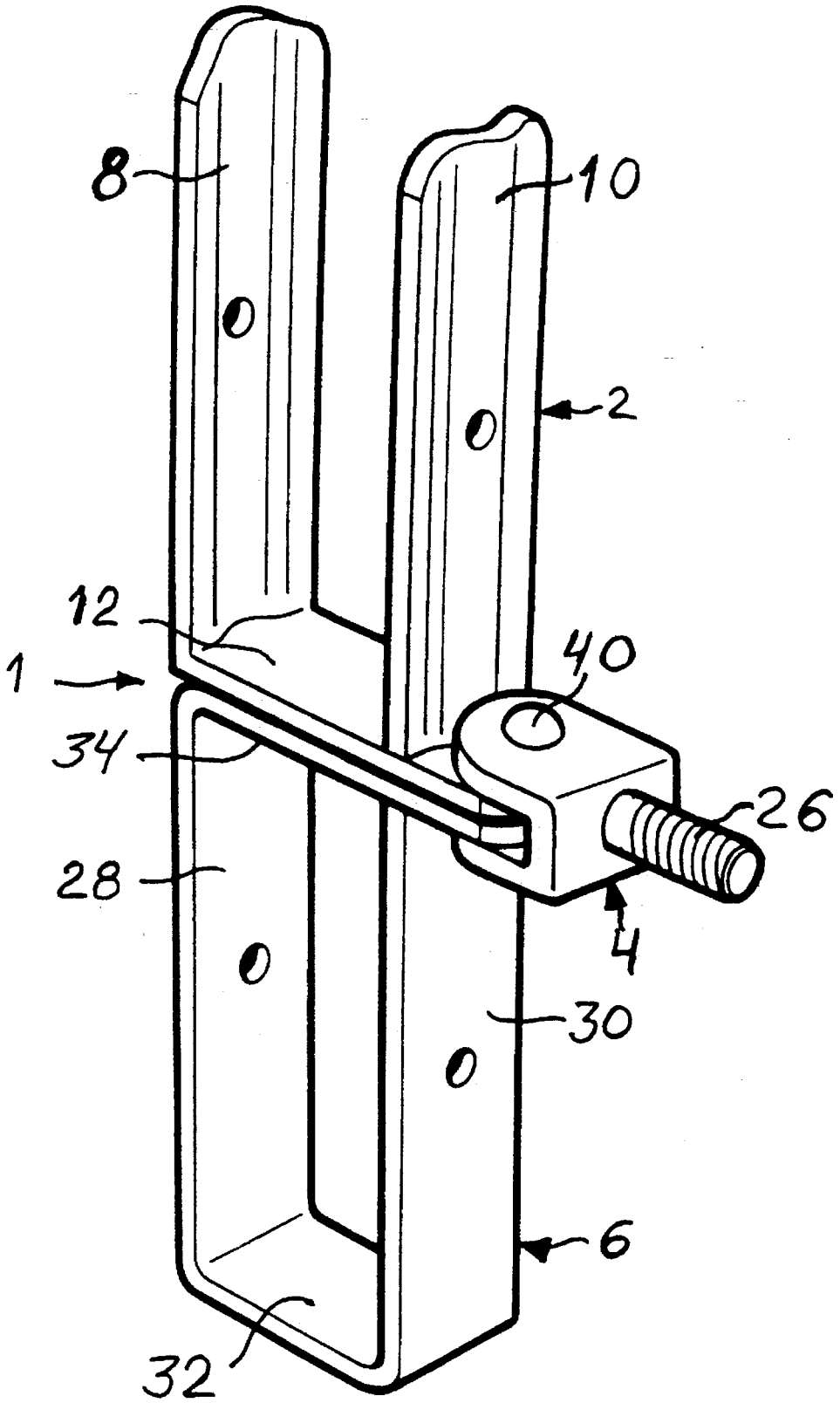

Fig. 3
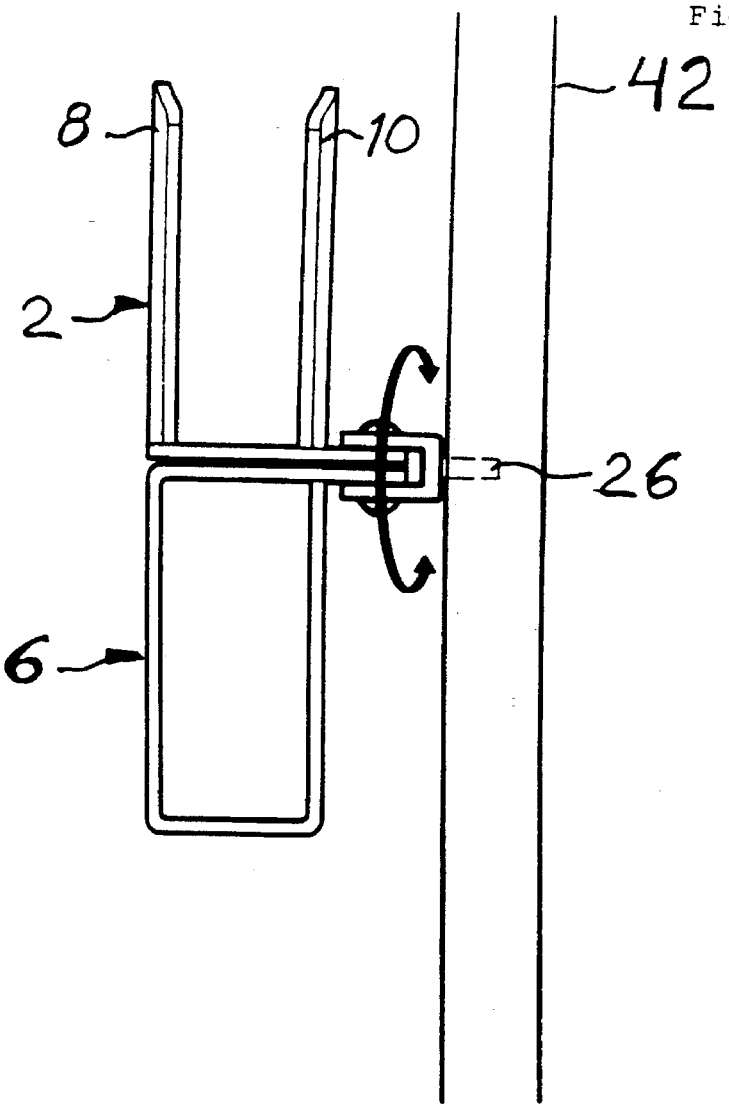
FIG. 4
Fig. 4
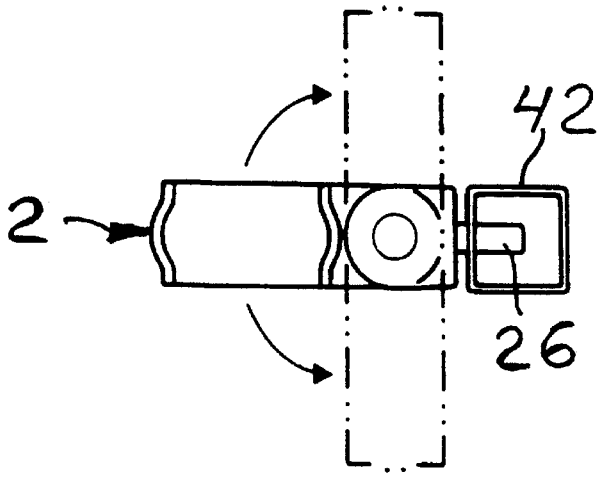

GUARD RAIL FITTINGS

The invention relates to a guard rail fitting. These guard rails are primarily intended to protect construction workers. If posts are used, these can be releaseably fixed in various manners, for example by being placed in sleeves embedded in concrete or being fixed by a clamping device. The guard elements used are in most cases boards which are fixed in the fittings by means of nails. Instead of boards, common pipes or aluminum profiles can be used which are then locked in the fittings with stop screws or lock screws.

In known fittings of the above disclosed type, each post is provided with an upper and a lower fitting which is welded in place, each having a lower rectangular opening for receiving a board and an upper holder which is open upwards so that a board can be laid in the holder. Such guard rails have been used for many years and function satisfactorily when the posts are directed in a normal vertical position and the fittings on the posts lie in alignment with each other.

However, difficulties arise in mounting guard elements if the posts are not parallel and/or are twisted relative to each other so that the fittings on one post are directed in another direction than the fittings on the next post. In order to make it possible to mount the guard elements, the positioning of the posts must then be adjusted or curved guard elements must be used, and this is often time-consuming and in certain cases not possible. Conventionally, a guard rail cannot be bent 90°. Rather, at the corners two posts must be used, which is time-consuming and costly.

The purpose of the present invention is therefore to provide a fitting for the posts in question, such that the required changes in the positioning of the fitting can be carried out simply on a post which is mounted in a fixed position or at a fixing point which is anchored directly in the building structure.

The fitting according to the invention thus consists of two main components, which are rotatable relative to each other to the desired position for receiving the guard elements in the form of boards, pipes or aluminum profiles or guard elements formed as guard nets which can be locked to individual main components. The fitting as a unit is in turn supported by a pin or screw which is joined to the construction frame either directly or via a post. When being fixed to a post, the pin or screw is inserted through a hole in the post and is fixed by means of a locking device, either in the desired angular position or is rotatably fixed. For fixing directly in the building structure, i.e. at the edge of a wall, a hole is drilled for an expander plug or the like in the desired position. The fitting can then be screwed into the expander plug and be locked in the desired angular position. This adjustability makes it possible to set the main components of the fitting and the fitting as a whole in a variety of different positions adapted to the need in question.

A preferred embodiment of the fitting according to the invention and its different uses are shown as examples in the accompanying drawings and are explained in more detail in the following description.

Figure 2:
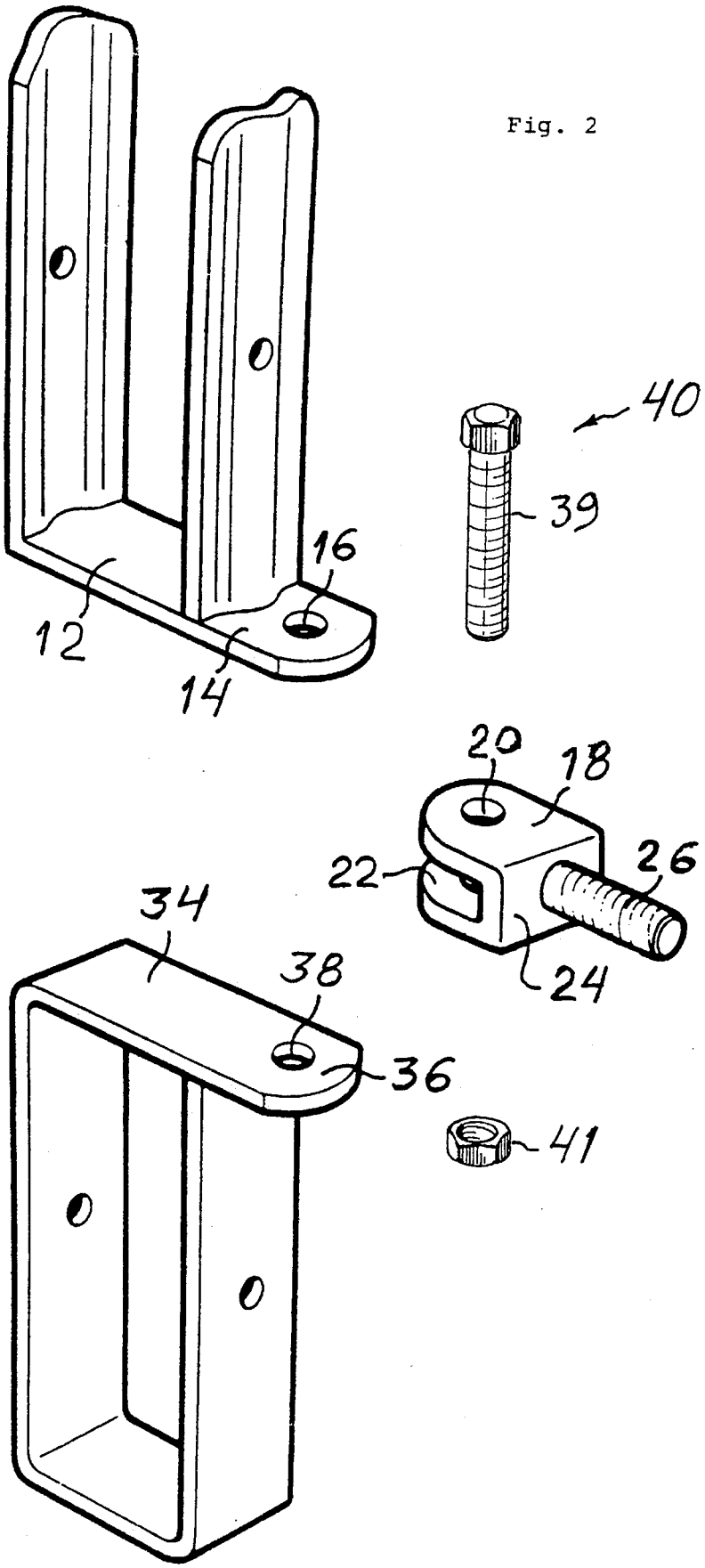

FIG. 1 is a perspective view of the fitting, FIG. 2 shows the fitting in perspective prior to assembly, FIG. 3 shows a side view of the fitting mounted on a post, and FIG. 4 shows the fitting according to FIG. 3 as seen from above.

A fitting 1 for fixing the guard elements to the guard rail consists of an upper main component 2 which, by means of a clevis 4, is pivotally joined to a corresponding lower main component 6. The upper main component is made as a holder 2 which is open upwards with an outer leg 8 and an inner leg 10. The holder 2 is made of flat bar steel, and the legs are profiled and parallel to each other and form right angles with a connecting portion 12. The connecting portion 12 extends outside the inner leg 10 into a lug 14 with a hole 16. Each of the legs 8 and 10 has a rounded upper portion and a bowl-shaped cross-section. The bowl-shape of the cross-section is best revealed in FIGS. 3 and 4. If the fitting as viewed from above in FIG. 4, the bowl-shape of the legs of the upper holder is quite evident. The facing side of the legs 8 and 10 have concave surfaces and the sides of the legs facing away from each other thus have convex surfaces. This bowl-shape extends over the major portion of the cross-section of the legs but flattens out towards the edges, so that the surfaces adjacent the edges (two on each leg) are parallel to each other. Both the leg 8 and the leg 10 have centrally located through-holes.

The lower main component has the shape of a rectangular holder 6 made of flat bar steel and comprising an outer side-piece 28 and an inner side-piece 30 which are parallel to each other and form right angles with a lower piece 32 and an upper piece 34. The upper piece 34 extends into a lug 36 which extends outside the side-piece 30 and has a hole 38. The two holders 2 and 6 are located so that the pieces 12 and 34 are in facing contact with each other.

The clevis 4 comprises two parallel plates, an upper mounting plate 18 and a lower mounting plate 22. The plates are joined to each other by means of a connecting piece 24 forming a right angle with each plate. In the centre of the connecting piece a threaded pin 26 is non-rotatably anchored, suitably by welding from the inside of the clevis. The end of each remote from the connecting piece is rounded to a circular arc at the centre of which a mounting hole 20 is disposed.

The clevis 4 is slipped onto the projecting lugs 14 and 36 in contact with each other, so that they are enclosed by the plates 18 and 22. The mounting holes 16, 20 and 38 are thus in alignment to receive a fastening element 40, e.g. a rivet or a screw 39 with a lock nut 41.

It is evident from FIGS. 3 and 4 that the fitting is mounted on a post 42 by insertion of the pin 26 in a hole drilled in the post. The pin is rotatably anchored in the post by a lock means (not shown). Thus the holders 2 and 6 can be set together at a desired suitable position about the horizontal axes. By connecting the upper holder 2, the clevis 4 and the lower holder 6 by means of the fastener element 40, the two holders are also pivotable relative to each other about the fastener 40. Depending on the setting about the rotational axis going through the pin 26, each of the holders 2 and 6 can be set in any desired position relative to both the horizontal and the vertical axis. In the examples shown in the figures, the pivot axis going through the fastener or rivet 40 coincides with the vertical axis. The holder 2 can be pivoted relative to the holder 6 a maximum of about 180°–200°.

The fitting can be applied at any height and in any number, e.g. on a previously embedded pipe, a post, an existing scaffold, a wall, various types of shafts or other vertical surfaces. The anchoring can be done directly in the wall end at the edge of the arch or at the arch edge itself. Special fastening means are not required. When anchoring in concrete, a hole is drilled for an expander plug or the like, into which the fitting is screwed. When fixing in a pipe or post, holes are drilled in the post and the fitting pin is anchored rotatably as needed or is anchored by means of a locking means on the inside of the pipe. The locking means can, for example, be a lock nut, a lock washer or a lock pin. With the adjustable fitting according to the invention, only one post is required or, for mounting on the edge of a wall, one fitting set at each anchoring point.

The special design of the upper holder 2, such that each plate has an arched cross-section, so-colled "grooving", makes the upper holder more rigid, since it is open upwards and would be weaker if it had the same cross-sectional shape as the lower closed holder 6. Thus, equivalent rigidity and strength can be achieved in both holders without having to increase the dimensions of the upper holder.

I claim:

1. A fitting comprising an upper main component (2) and a lower main component (6) for supporting an individual guard element, said upper main component being made as a holder (2) which is open upwards with an outer leg (8) and an inner leg (10), said outer and inner legs being connected by a connecting portion (12), which extends outside the inner leg (10) into an upper lug (14), said lower component being shaped as a rectangular holder (6), with an outer side-piece (28), an inner side-piece (30), a lower piece (32) and an upper piece (34) which extends outside said inner side-piece into a lower lug (36), said upper and lower lugs (14, 36) being pivotally joined to each other along a pivot axis by means of a clevis (4) with an anchoring pin (26) and a fastening element, on which clevis the upper and lower lugs (14, 36) are pivotally mounted, said anchoring pin being arranged essentially perpendicular to the pivot axis of the lugs.

2. Fitting according to claim 1, characterized in that the upper main component (2) and the lower component (6) of the fitting (1) are pivotable relative to each other through an angle which is essentially 180°.

3. Fitting according to claim 1, characterized in that the upper main component and the lower main component are pivotable relative to each other, each comprises a holder (2, 6) made of flat bar steel, into which holders a guard element can be inserted and can be releaseably locked.

4. Fitting according to claim 1, characterized in that the upper main component and the lower main component of the fitting each comprises a holder (2, 6) made of bar steel.

5. Fitting according to claim 1, characterized in that the outer (8) and inner (10) legs of said upwards open holder (2) comprises a groove.

6. Fitting according to claim 1, characterized in that the upper main component (2), the lower main component (6) and the clevis (4) are held together by a rivet (40) with a pre-determined friction between the upper and lower main components.

7. Fitting according to claim 1, characterized in that the fastening element for the upper main component (2), the lower main component (6) and the clevis (4) comprise a screw (39) with a lock nut 41 for locking the upper and lower main components in a desired position.

8. Fitting according to claim 1, characterized in that the pin (26) is insertable into a hole in a post (42) from one side thereof to be rotatably fixed by a locking means on the inside of the post.

9. Fitting according to claim 1, characterized in that the pin is a screw (26) which is tightenable with a locking means on the inside of a post (42) to lock the fitting in any selective position.

10. Fitting according to claim 1, characterized in that the pin is a screw (26) which is intended to be inserted into a hole in a construction element such as an arch edge or a wall edge, to be tightened in any selective position on the construction element.

11. A fitting (1) comprising:

an upper main component (2);

a lower main component; and a clevis portion (4);

said upper main component comprising an outer leg (8) and an inner leg (10) facing each other in parallel, a lower end of said outer leg and a lower end of said inner leg being perpendicularly joined by a connecting portion (12), one end of said connecting portion extending beyond the lower end of said inner leg forming an upper lug (14) with an upper hole (16);

said lower main component comprising an outer side-piece (28) and an inner side-piece (30) facing each other in parallel, a lower end of said outer side-piece and a lower end of said inner side-piece being perpendicularly joined by a lower piece (32), an upper end of said outer side-piece (28) and an upper end of said inner side-piece being perpendicularly joined by an upper piece (34), one end of said upper piece (34) extending beyond the upper end of said inner side-piece forming a lower lug (36) with a lower hole (38);

said clevis portion comprising an upper mounting plate (18) with an upper mounting hole (20) and a lower mounting plate (22) with a lower mounting hole, said upper mounting plate and said lower mounting plate facing each other in parallel, a straight end of said upper mounting plate and a straight end of said lower mounting plate being perpendicularly joined by a connecting piece (24), said connecting piece comprises a pin (26);

said upper main component being positioned on top of said lower main component so that said connecting portion (12) is on top of and parallel to said upper piece (34), said upper lug and said lower lug being disposed in a gap formed between said upper mounting plate and said lower mounting plate so that said upper hole, said upper mounting hole, said lower hole and said lower mounting hole are aligned with each other, and a fastening element (40) extending through these holes to couple said upper main component, said lower main component and said clevis portion together.

* * * * *